US006654225B2

(12) United States Patent
Takayanagi

(10) Patent No.: US 6,654,225 B2
(45) Date of Patent: Nov. 25, 2003

(54) DIRECT-CURRENT PUSH-PULL TYPE OF STATIC ELIMINATOR

(75) Inventor: Makoto Takayanagi, Shizuoka (JP)

(73) Assignee: Takayanagi Research Inc., Shizuoka (JP)

( * ) Notice: Subject to any disclaimer, the term of this patent is extended or adjusted under 35 U.S.C. 154(b) by 256 days.

(21) Appl. No.: 09/862,818

(22) Filed: May 21, 2001

(65) Prior Publication Data

US 2002/0008953 A1 Jan. 24, 2002

(30) Foreign Application Priority Data

May 26, 2000 (JP) ..... 2000-155679
Jul. 19, 2000 (JP) ..... 2000-218513
Feb. 2, 2001 (JP) ..... 2001-026520

(51) Int. Cl.[7] ..... H05F 3/00
(52) U.S. Cl. ..... 361/231; 361/232
(58) Field of Search ..... 361/230, 231, 361/232, 233, 235

(56) References Cited

U.S. PATENT DOCUMENTS 5,245,503 A * 9/1993 Rodrigo ..... 361/231

* cited by examiner

*Primary Examiner*—Adolf D. Berhane
(74) *Attorney, Agent, or Firm*—Leighton K. Chong; Ostrager Chong & Flaherty (Hawaii)

(57) ABSTRACT

A static eliminator comprises one pair of discharge electrodes. One electrode issues ions of a polarity while the other electrode issues ions of opposite polarity. In addition to the foregoing, polarity of ions issued from each of said discharge electrodes is switched over to opposite polarity. The switching over of polarities is synchronized with each other so that ions issued from each discharge electrodes are of opposite polarities. In another embodiment, static eliminator comprises a rotary ionizer or rotary ion issuing discharge electrodes. In still another embodiment, static eliminator comprises more than three arrayed discharge electrodes, each of discharge electrodes issues ions of opposite polarity to that issued from adjacent discharge electrodes.

13 Claims, 22 Drawing Sheets

DIRECT-CURRENT PUSH-PULL TYPE OF STATIC ELIMINATOR

BACKGROUND OF THE INVENTION

This invention relates to a static eliminator.

A conventional static eliminator has only a short flying distance of ions. In particular, an alternate current type of static eliminator has a very short flying distance of ions since plus ions and minus ions recombine to each other immediately after their generation. Therefore, the ions must be flied away by a blower. On the other hand, a direct current type of static eliminator can achieve a more flying distance to some extent. However, it merely reaches 70 cm at most. As a result, in actual use, sufficient effects of static elimination cannot be achieved because of lack of flying distance of ions.

Figure 1:
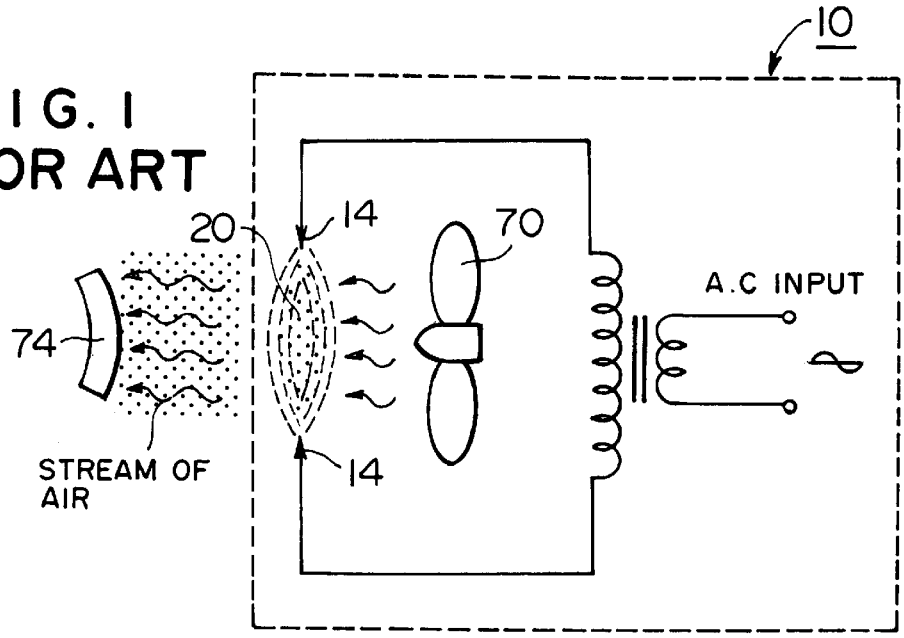
FIG. 1 PRIOR ART
Figure 2:
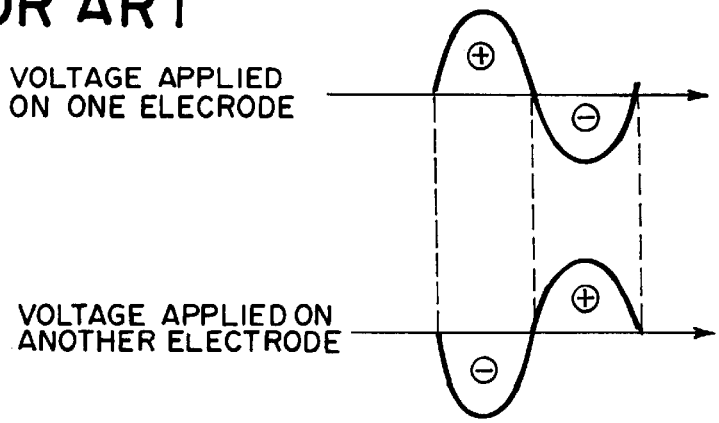
FIG. 2 PRIOR ART
Figure 3:
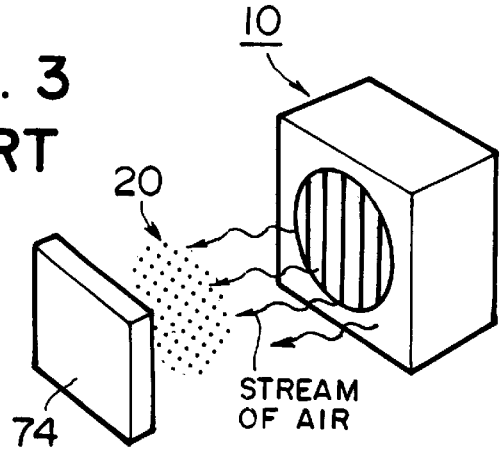
FIG. 3 PRIOR ART

As shown in FIGS. 1 through 3, the voltage in alternate current input is boosted to be discharged from discharge electrodes or needles 14, 14 in a static eliminator 10 and the ions thus generated are directed by a fan 70 toward a body 74 to be statically eliminated. In this case, since the distance between the needles 14, 14 are relatively short, the electric field on the electrodes is strengthened. As a result, corona discharge is more likely generated from the discharge needles.

Figure 4:
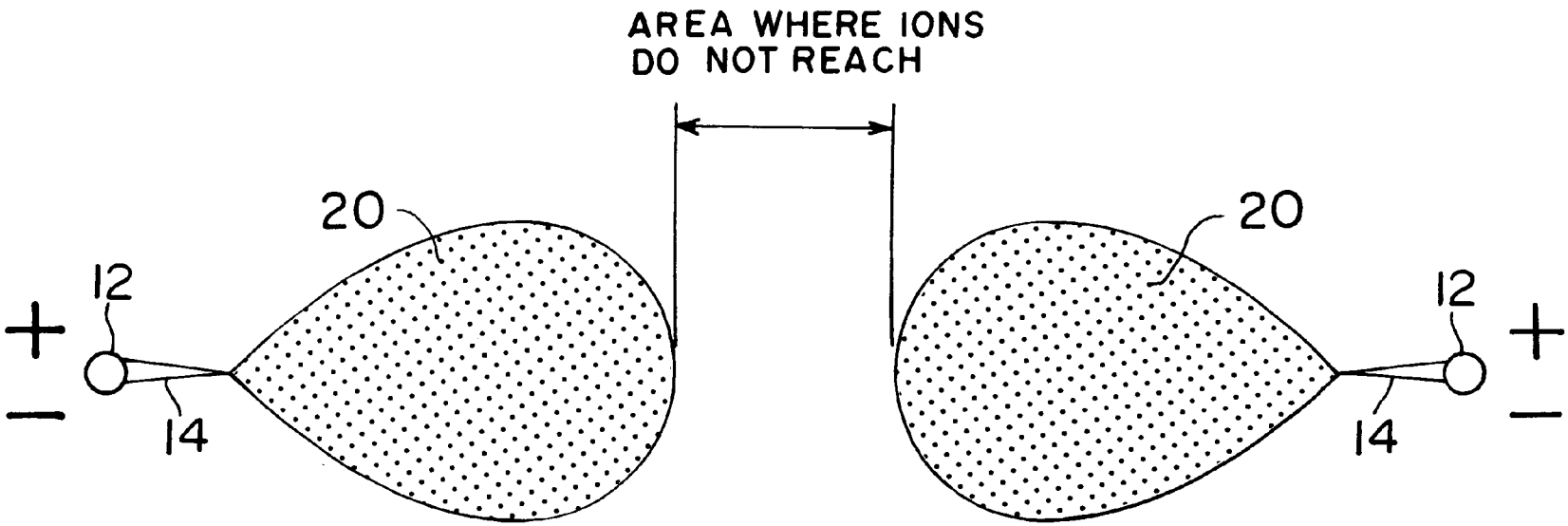
FIG. 4 PRIOR ART

As for one example, FIG. 4 shows a situation in that the area where static electricity cannot be removed exists since the flying distance from the discharge electrode 14 is short and the ions do not reach the center area between the discharge electrodes 14, 14 which are provided on power supply lines 12, 12.

Figure 5:
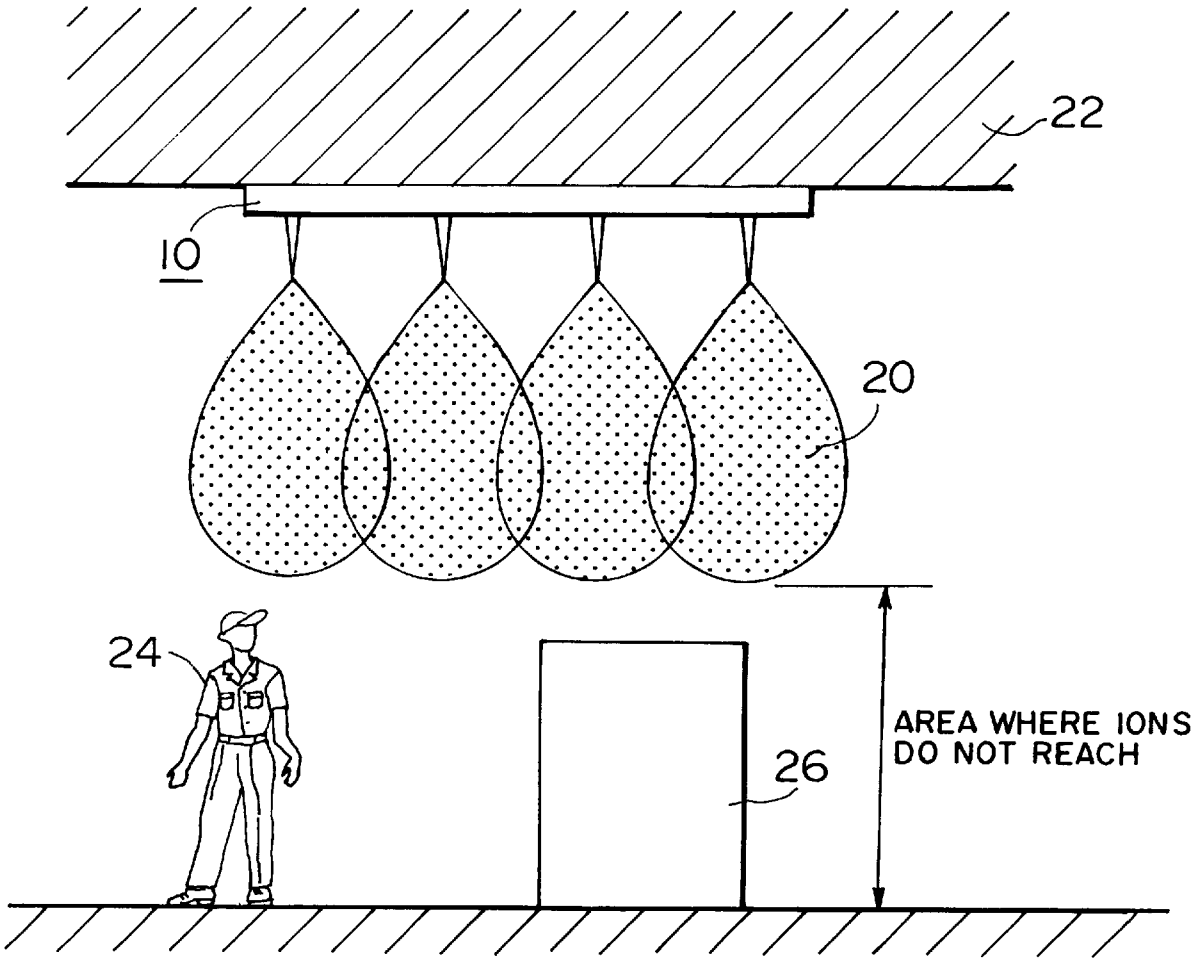
FIG. 5 PRIOR ART

As for another example, FIG. 5 shows another situation in that static electricity is eliminated in a clean room for semiconductor production. Since the ions 20 issued from the static eliminator 10 provided on the ceiling 22 reach 1 meter at most from the ceiling 22, static electricity cannot be eliminated from a person 24, work 26 and the like.

Figure 6:
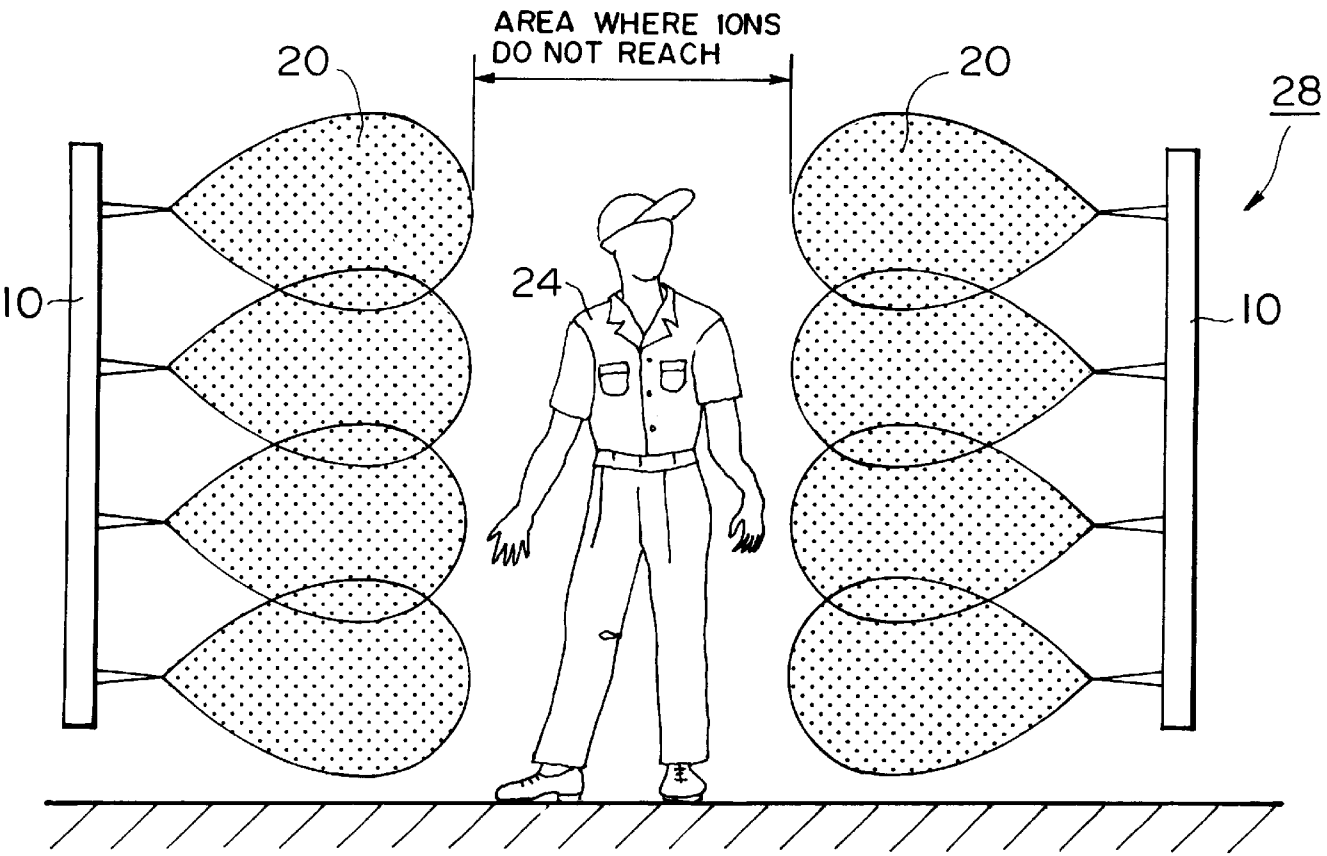
FIG. 6 PRIOR ART

As for a still another example, FIG. 6 shows a still another situation in that the area where static electricity cannot be eliminated exists in the central portion between the static eliminators 10,10 provided in the gate 28 since the ions 20 do not reach. Therefore, the gate should be made narrow which results in inconvenience in actual use.

Thus, with conventional static eliminators, sufficient effects of static elimination cannot be achieved in a large area because of lack of flying distance of ions.

Figure 16:
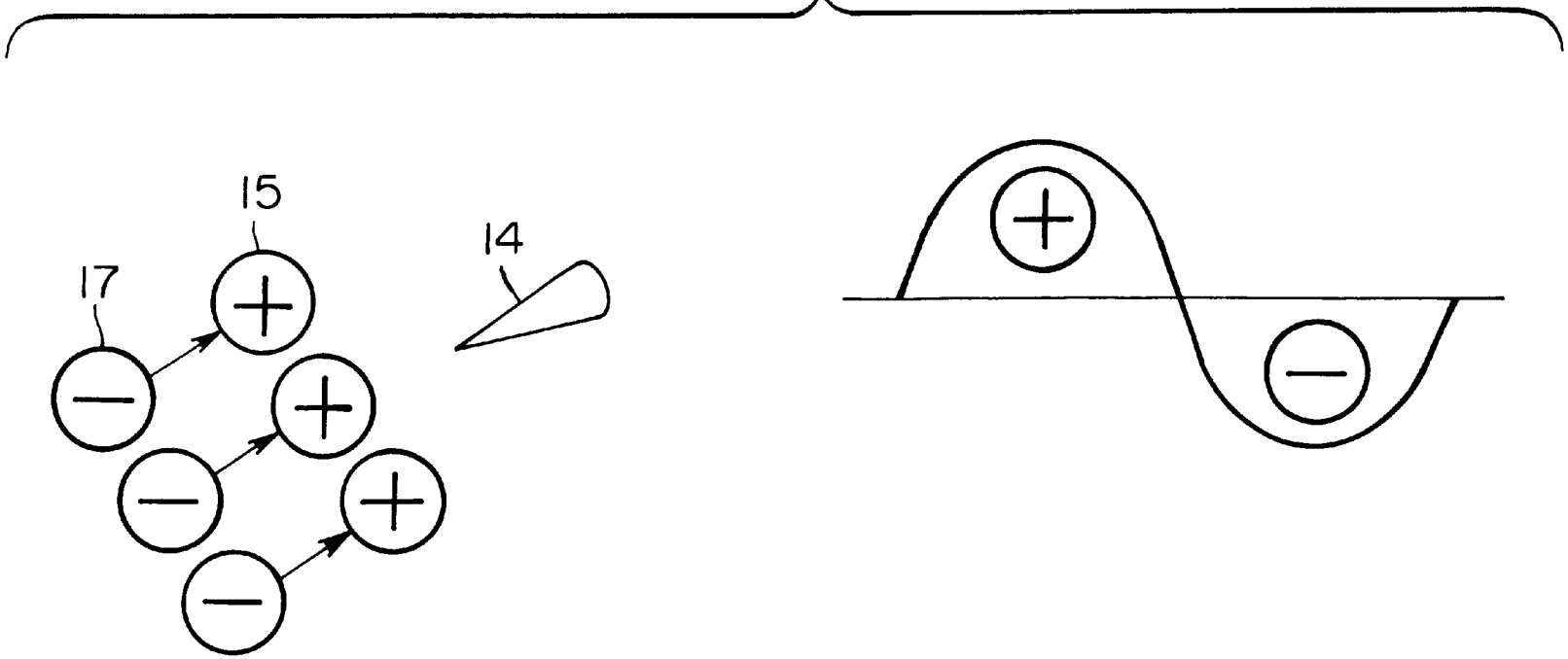
FIG. 16 PRIOR ART

FIG. 16 shows a still another example of static eliminator. In FIG. 16, the static eliminator is of an alternate current type, and alternately issues plus ions 15 in a positive half cycle and minus ions 17 in a next negative half cycle from a discharge electrode 14. Thus, the plus ions 15 and minus ions 17 issued from the discharge electrode 14 are, respectively, drawn back by the minus ions 17 and the plus ions 15 of opposite polarities and recombine them to disappear. Therefore, the static eliminator of this type cannot fly the issued ions away sufficiently.

Figure 17:
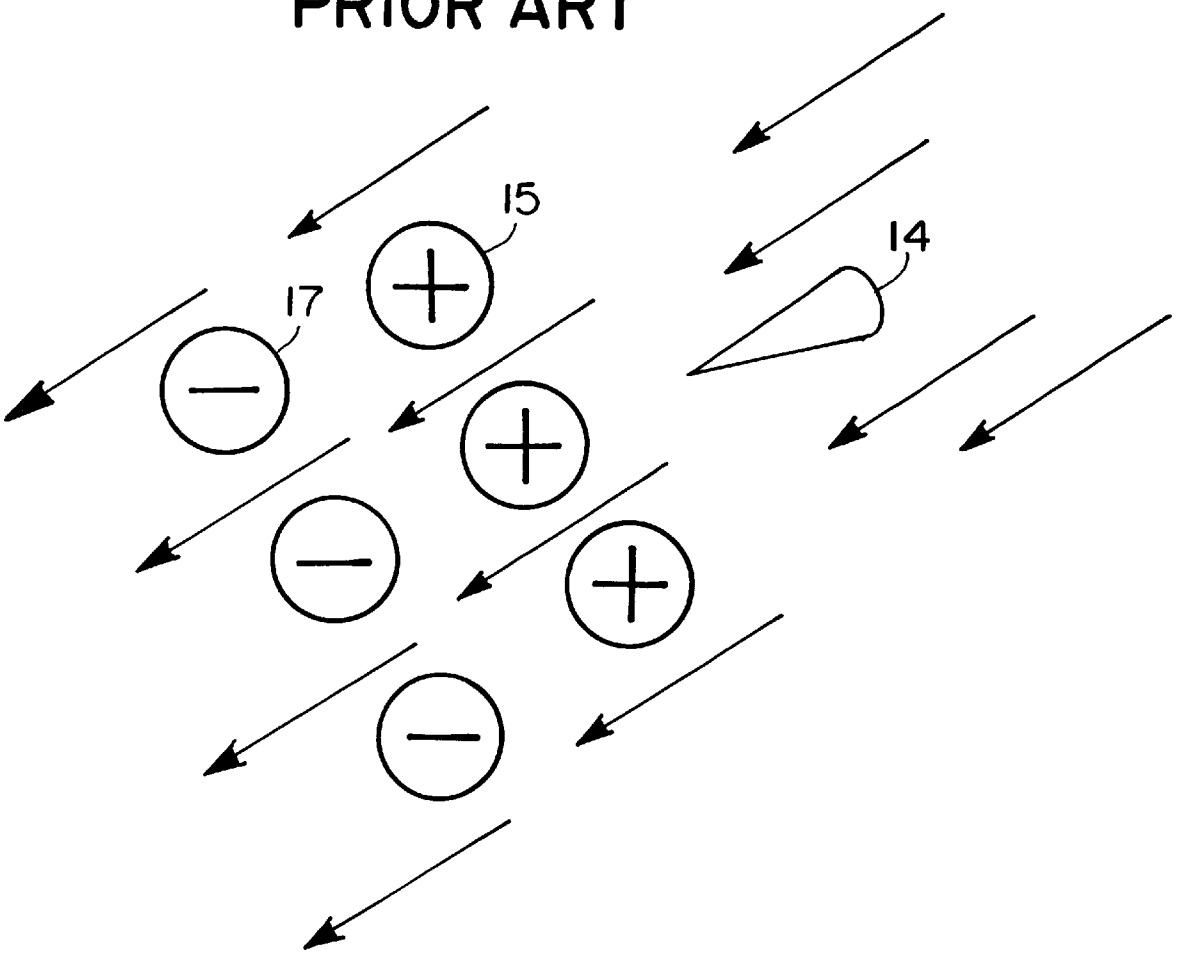
FIG. 17 PRIOR ART

Then, as shown in FIG. 17, a strong stream of air should be led around the discharge electrode 14 to prevent plus ions 15 and minus ions 17 from recombining to each other. Actually, unless the compressed air is used, or a blower or a fan is used to blow the discharge electrode 14, the generated ions cannot be taken out.

However, this static eliminator has an advantage in that if stream of air is supplied, plus ions 15 and minus ions 17 always come out in the mixed state. Then, the mixing of ions is in a good condition and the distribution balance of ions is also in a good condition.

Figure 18:
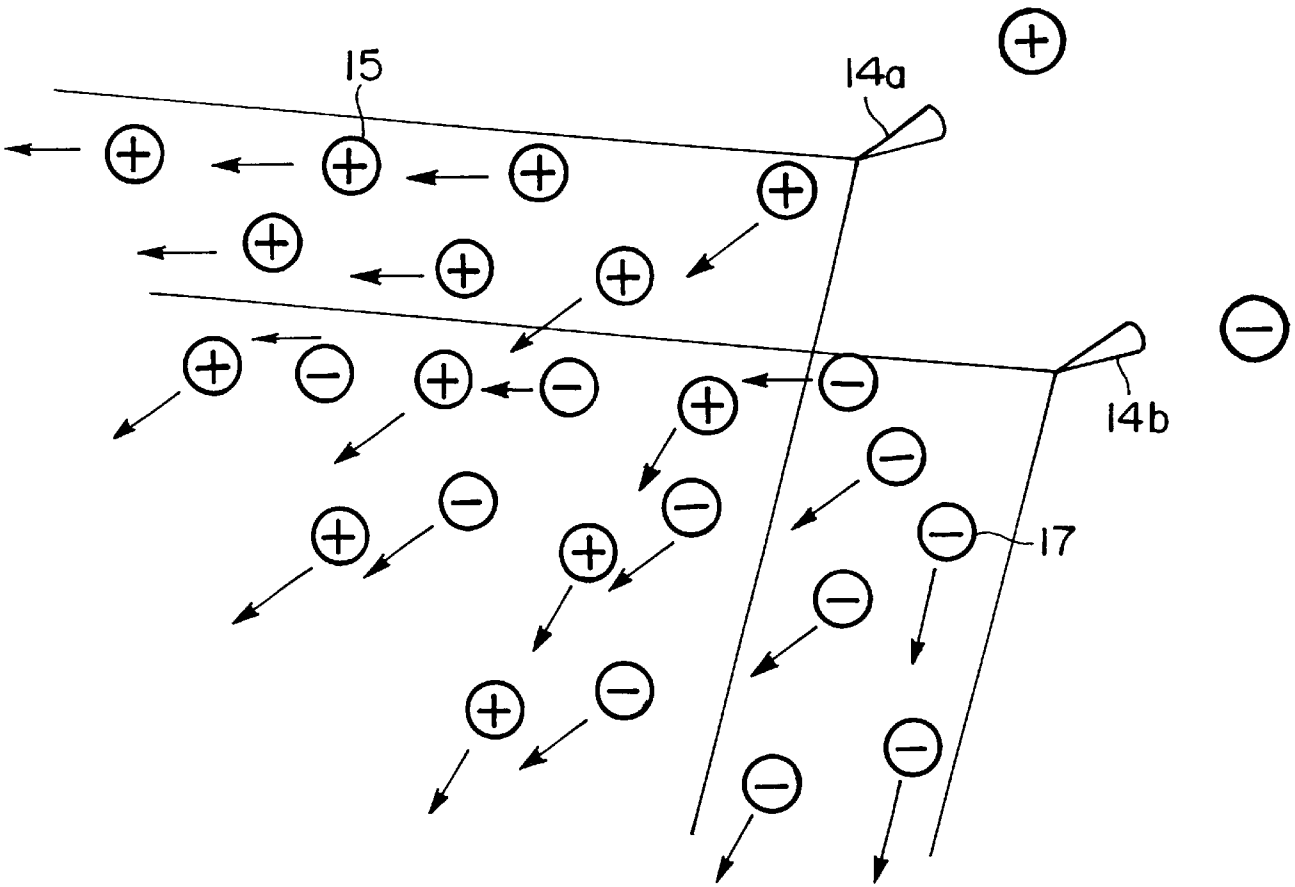
FIG. 18 PRIOR ART

On the other hand, as shown in FIG. 18, in a direct current type of static eliminator, two discharge electrodes or needles 14*a*, 14*b* are separately provided for issuing plus ions 15 and minus ions 17, respectively. Each of discharge needles issues ions of opposite polarity. In other words, the positive needle 14*a* issues plus ions and the negative needle 14*b* issues minus ions. Since each of discharge electrodes and the ions issued therefrom are of the same polarity, the ions are flied or pushed away by Coulomb's force. In other words, the ions 15, 17 automatically flies away to diffuse through a long distance without use of the compressed air, blower or fan. Therefore, its obtained long flying distance is characteristic of the static eliminator of this type.

However, since the distribution of plus ions and minus ions differs in position, the distribution balance of ions is not good. In order to overcome this disadvantage, the polarity of each of the discharge electrodes is caused to reverse sequentially so that the ions are easily mixed as much as possible. However, in this case, since the ions coming later have opposite polarity, the ions first come out are drawn back by the later coming ions, which results in the short flying distance.

Moreover, since the ions of opposite polarities are issued from the two electrodes in the physically separate positions, the mixing of the ions is not attained more than that of one electrode. In other words, plus-tendency ion balance is generated near the plus electrode and minus-tendency ion balance is generated near the minus electrode. When the polarity is reversed and the period for cycle of reversal of polarity is long, the variation in balance of ions appears along time axis. In order to mix the ions completely, the period for cycle of reversal of polarity should be shortened. However, if do so, this static eliminator approaches the alternate current type of static eliminator. In such a case, the ions do not fly away.

Thus, conventional systems have its merits and demerits. There has been no perfect static eliminator which has long flying distance and good balance of ions unless the stream of air by blowers, etc is utilized.

SUMMARY OF THE INVENTION

It is therefore an object of the present invention to provide a static eliminator which can extend flying distance of ions and can attain effects of static elimination through wide area sufficiently.

To accomplish the above-mentioned object, there is provided a direct current type of static eliminator which comprises one pair of discharge electrodes, one of said discharge electrode issuing ions while the other discharge electrode issues ions of opposite polarity.

In addition to the foregoing, the polarity of ions issued from each of the opposed discharge electrodes is caused to switch over to the opposite polarity. At that time, it is preferred that the switchover for each of discharge electrodes is made in timed relationship.

It is another object of the present invention to provide a static eliminator which can extend flying distance of ions without blowing of the discharge electrode by use of compressed air, blower or fan, suppress the variation in balance of ions in position, and suppress the variation in balance of ions along time axis.

To accomplish the above-mentioned object, there is provided a static eliminator which has a rotary ionizer or rotary ion issuing discharge electrodes.

It is a still another object of the present invention to provide an array type of static eliminator which can attain a more wide static eliminating space.

To accomplish the above-mentioned object, there is provided an array type of static eliminator in which more than three discharge electrodes are disposed and ions issued from adjacent discharge electrodes are of an opposite polarity.

Figure 7:
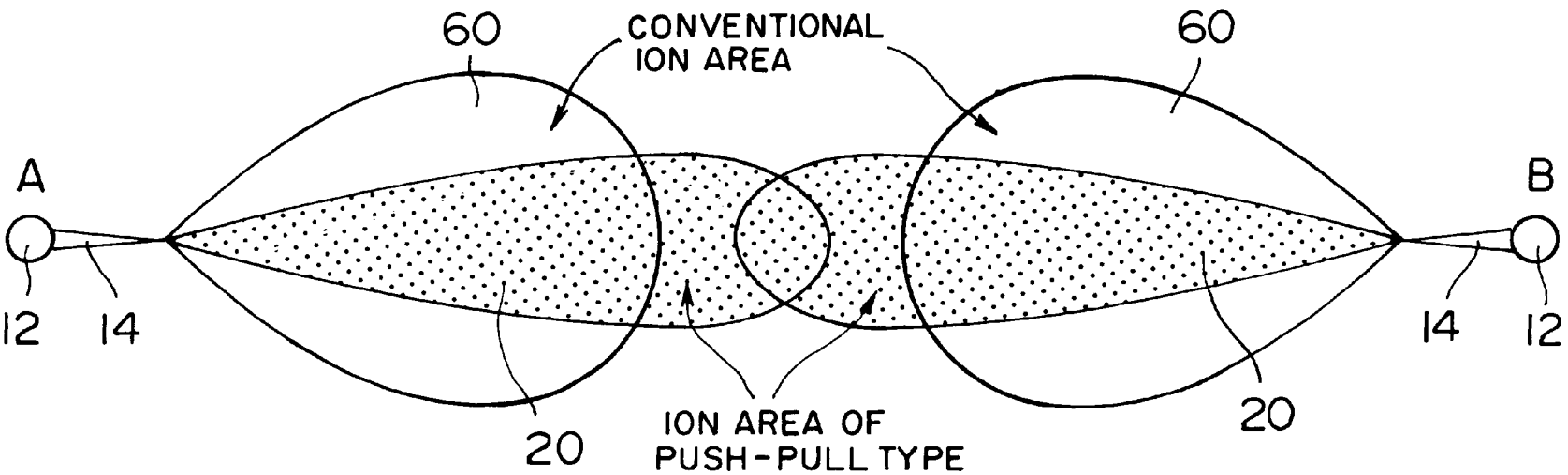
Figure 8:
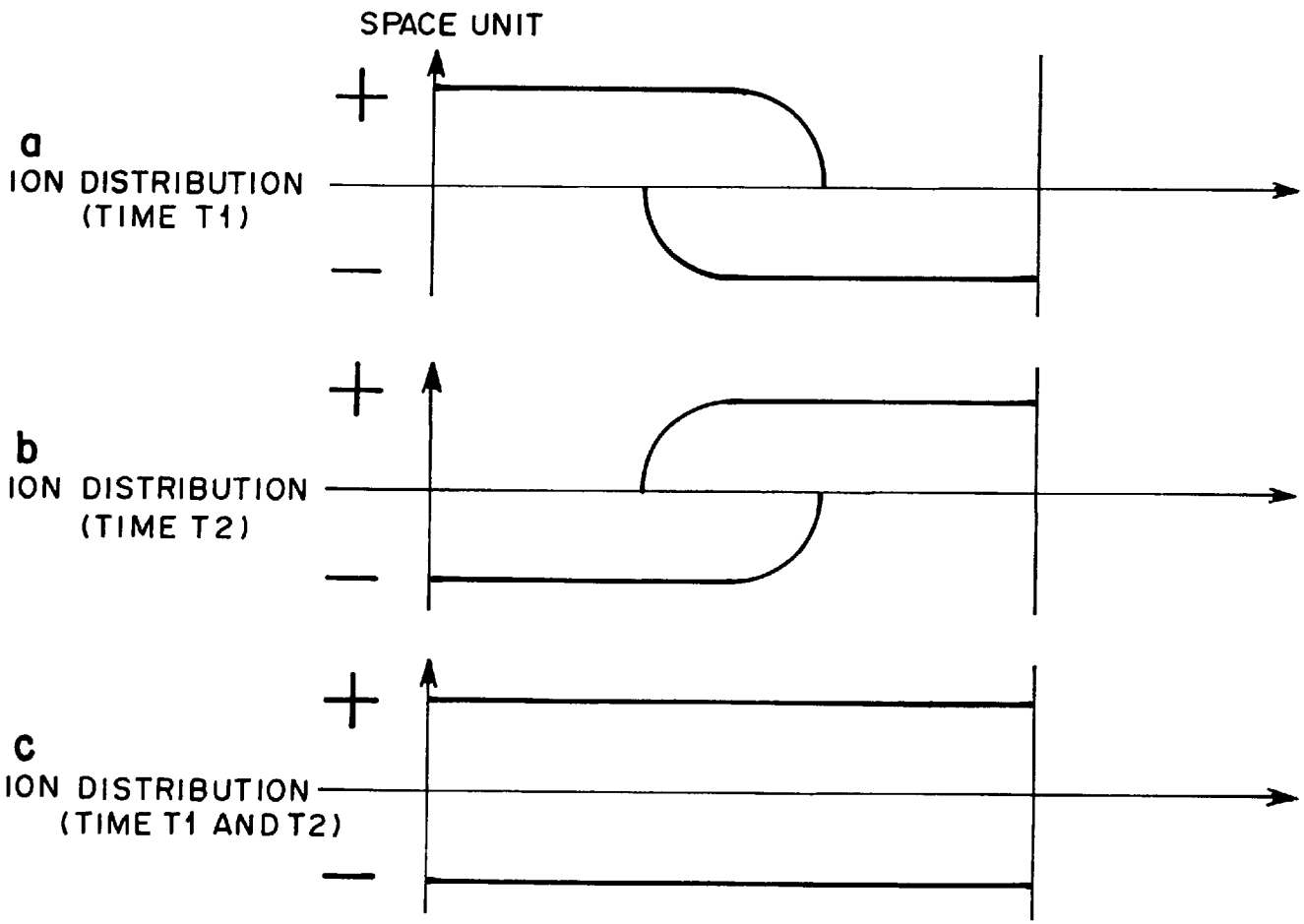
Figure 9:
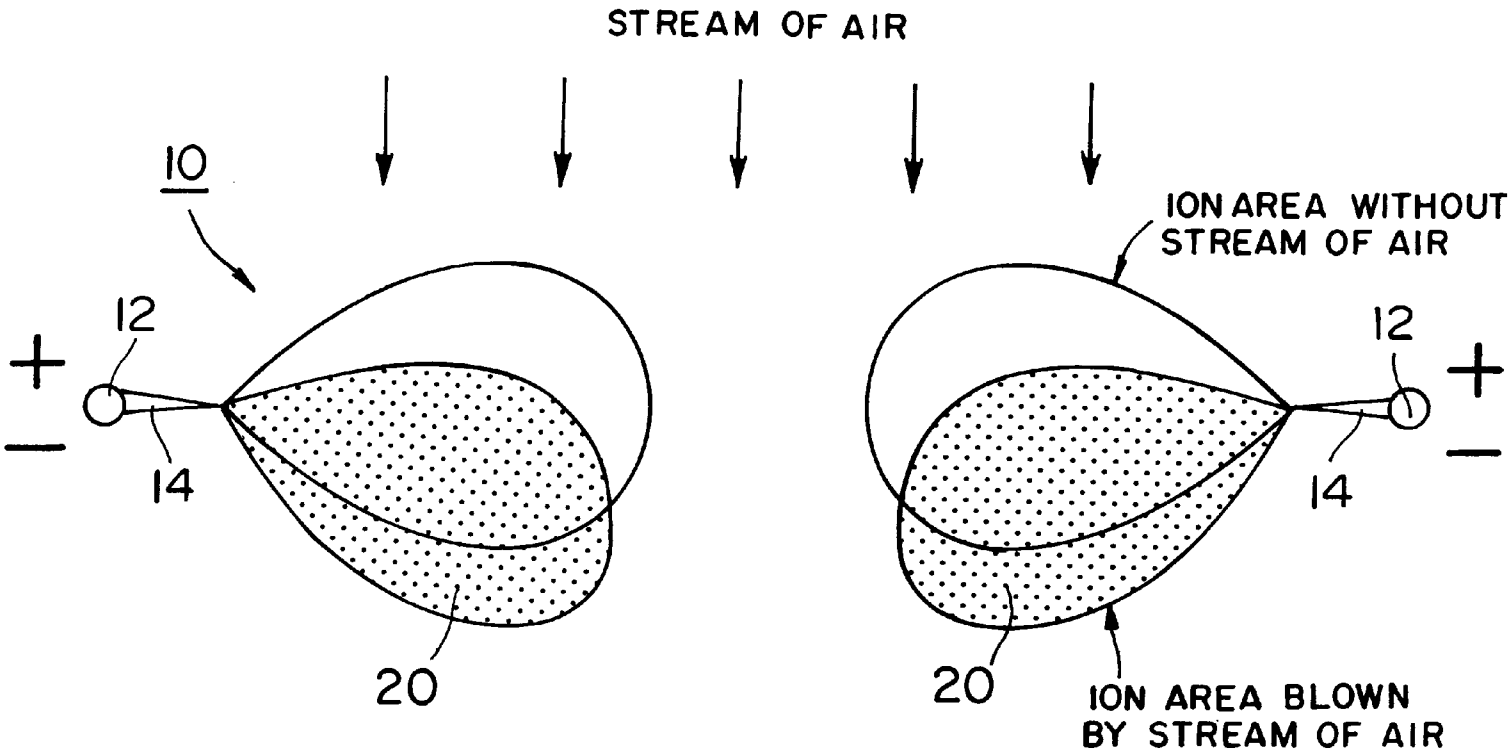
FIG. 9 PRIOR ART
Figure 10:
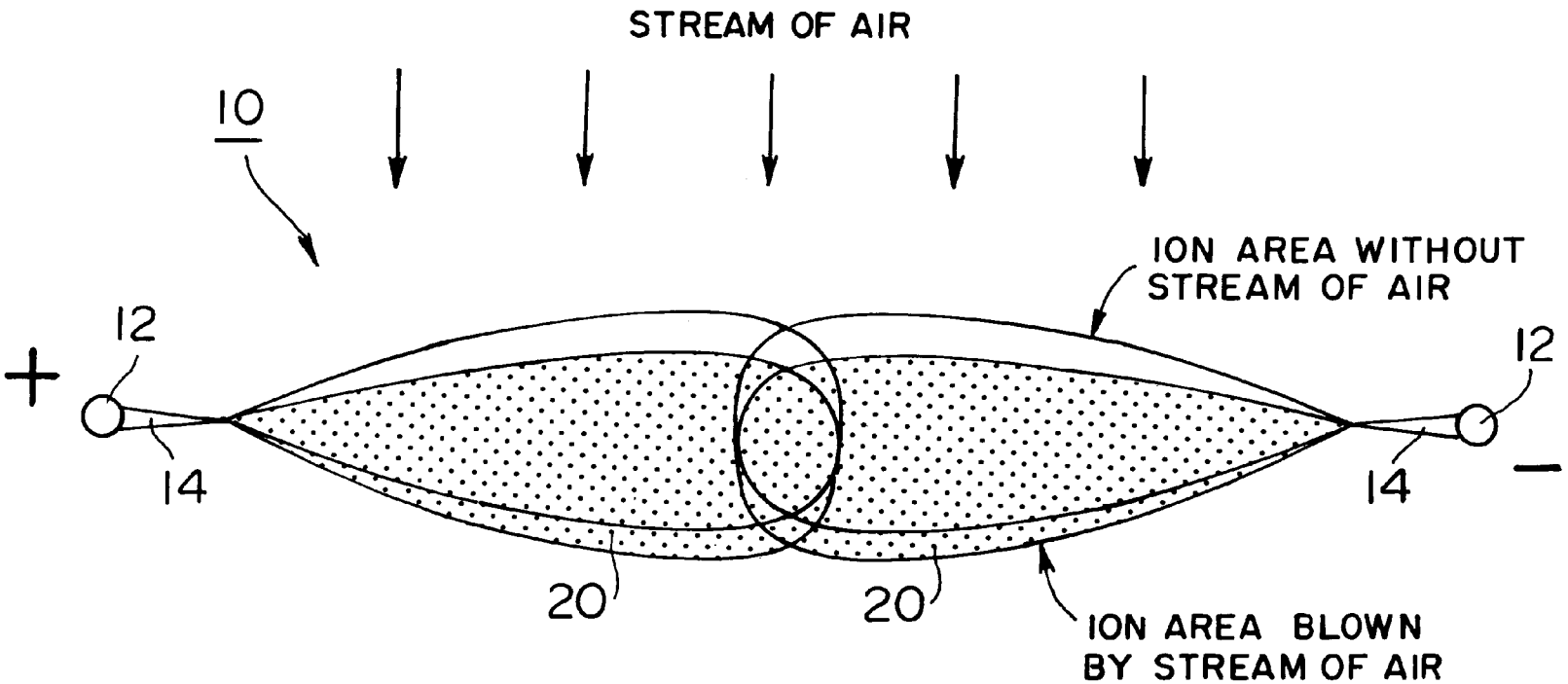
Figure 11:
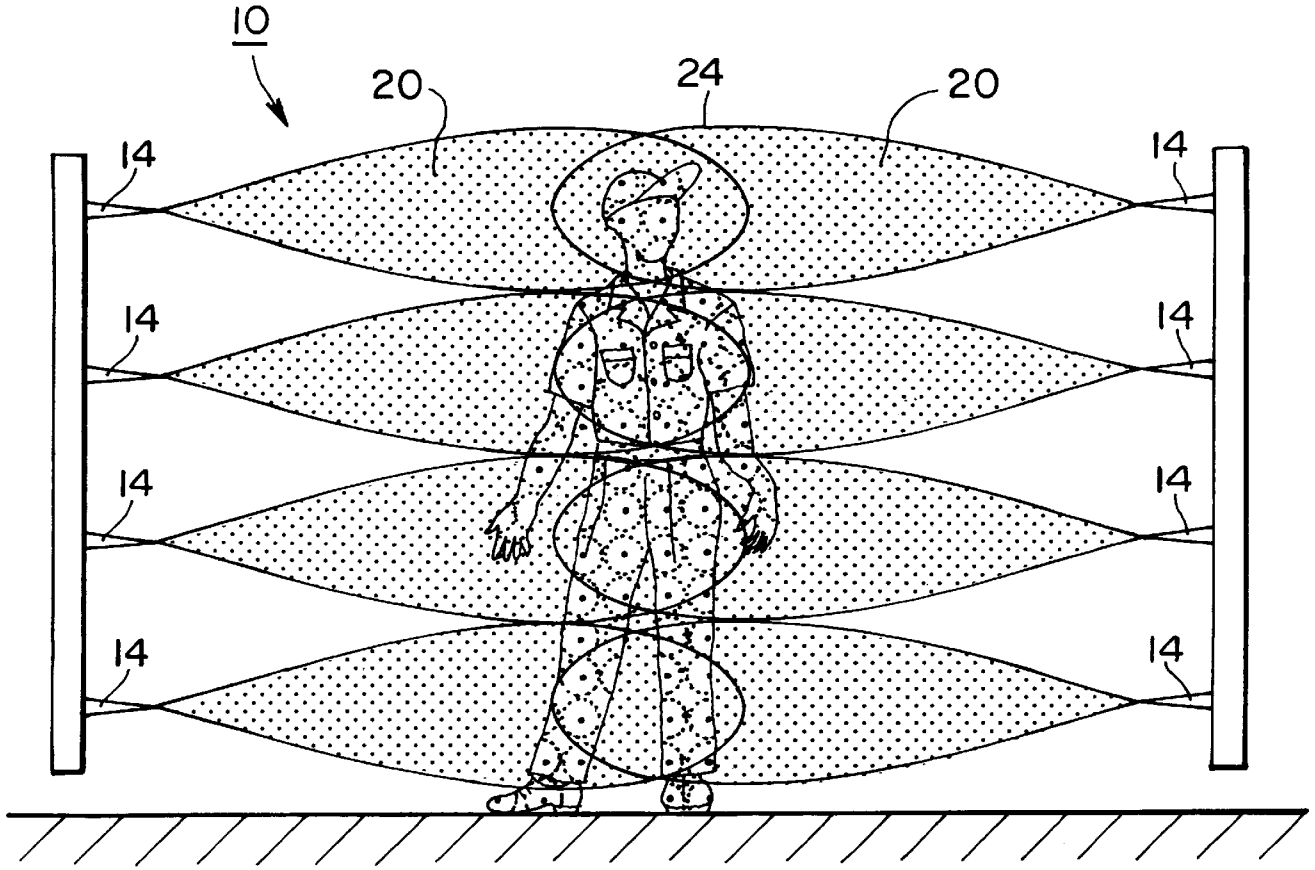
Figure 12:
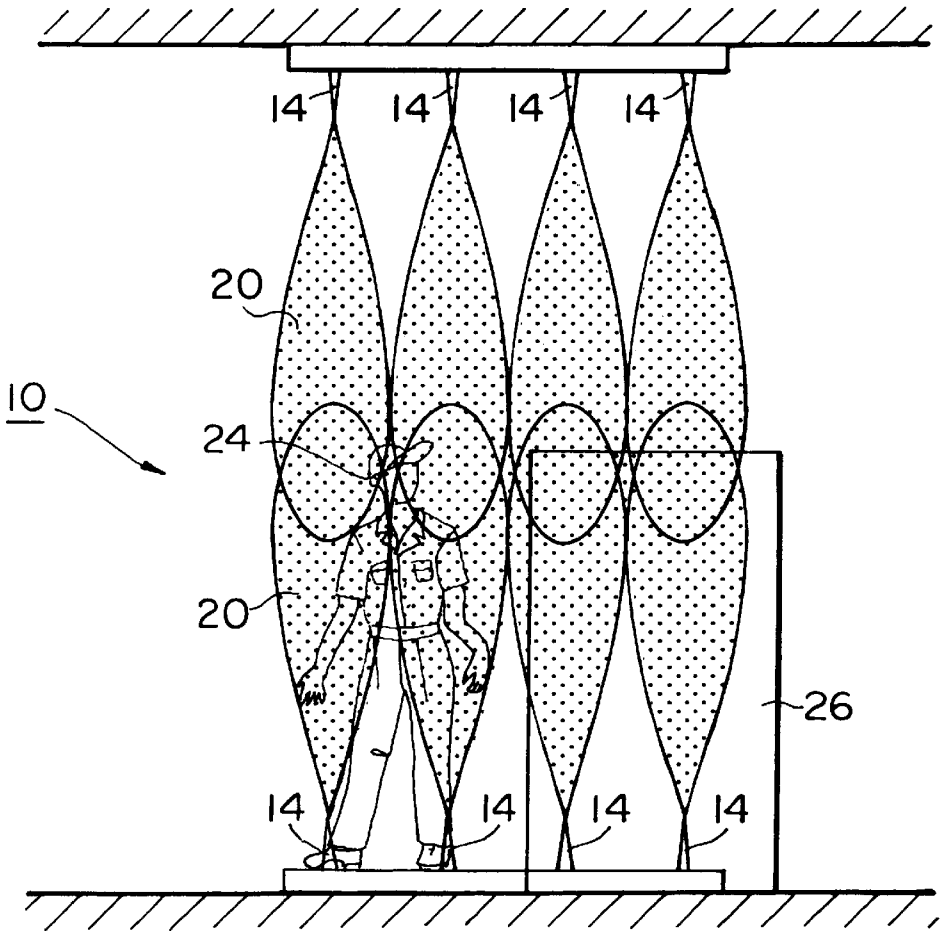
Figure 13:
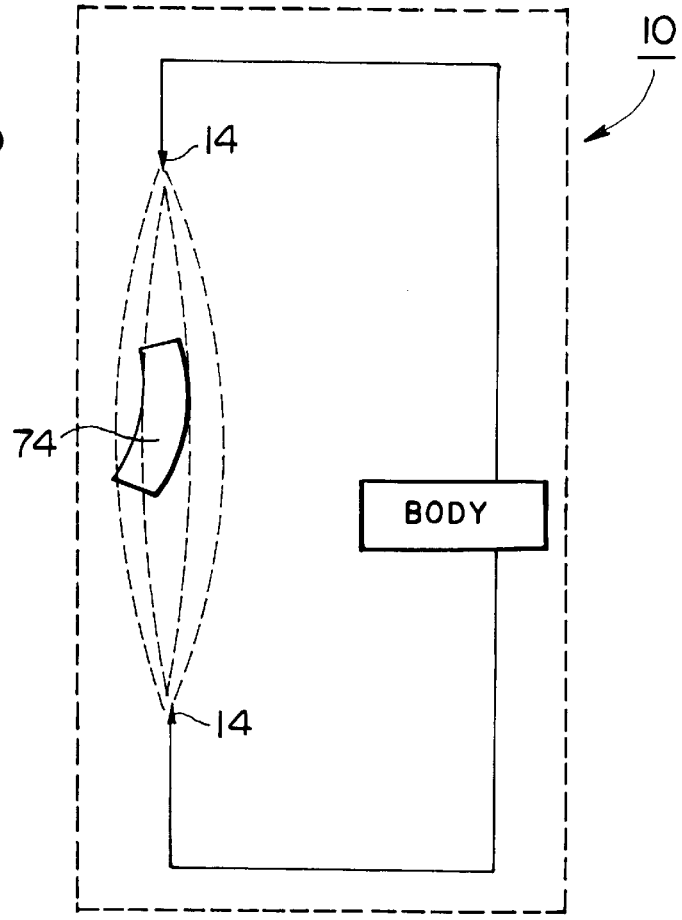
Figure 14:
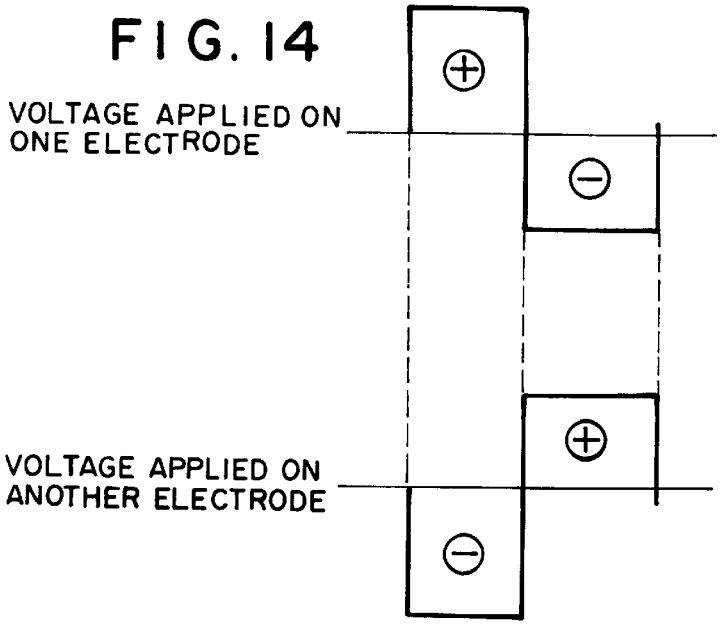
Figure 15A:
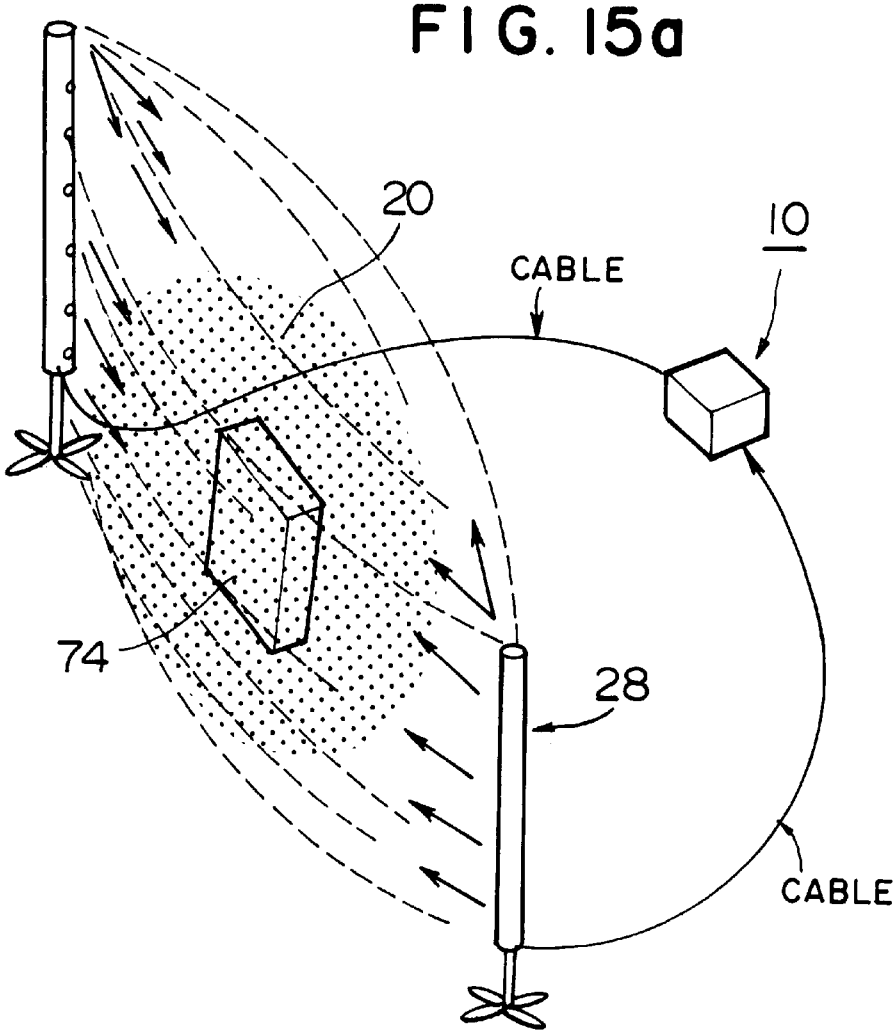
Figure 15B:
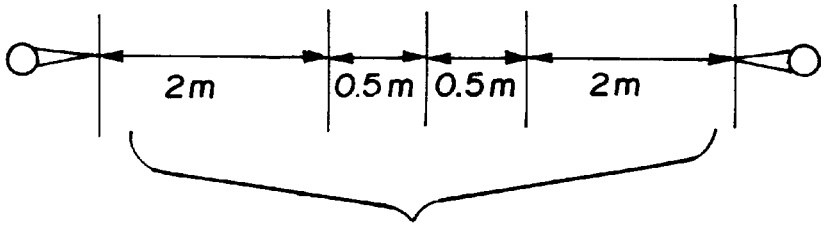
Figure 19:
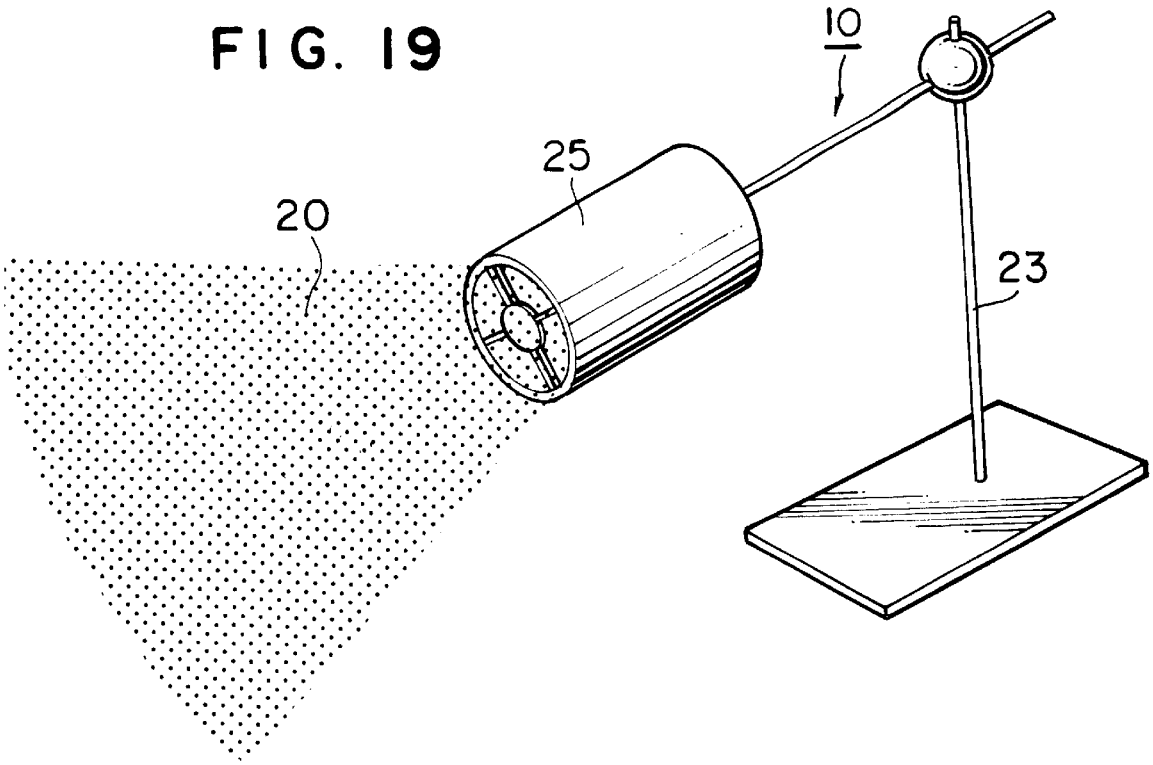
Figure 20:
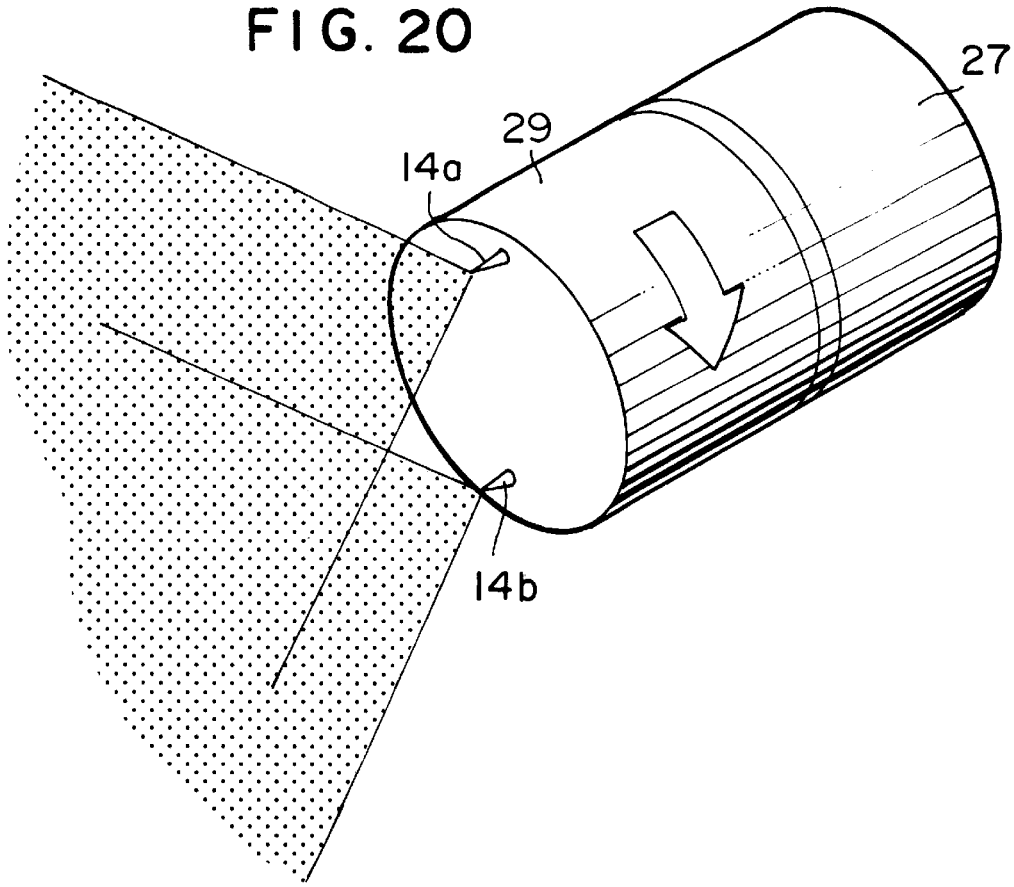
Figure 21:
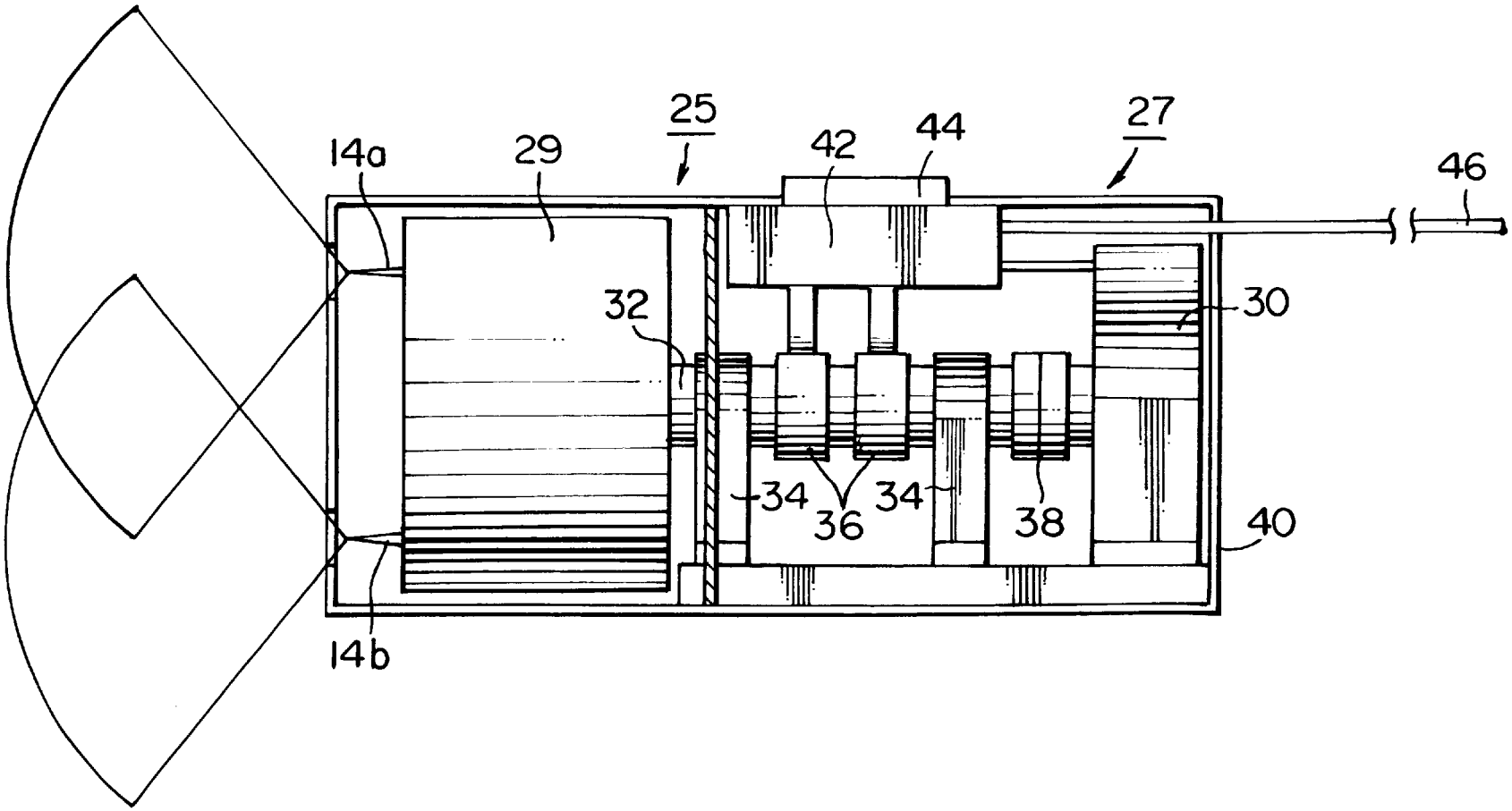
Figure 22A:
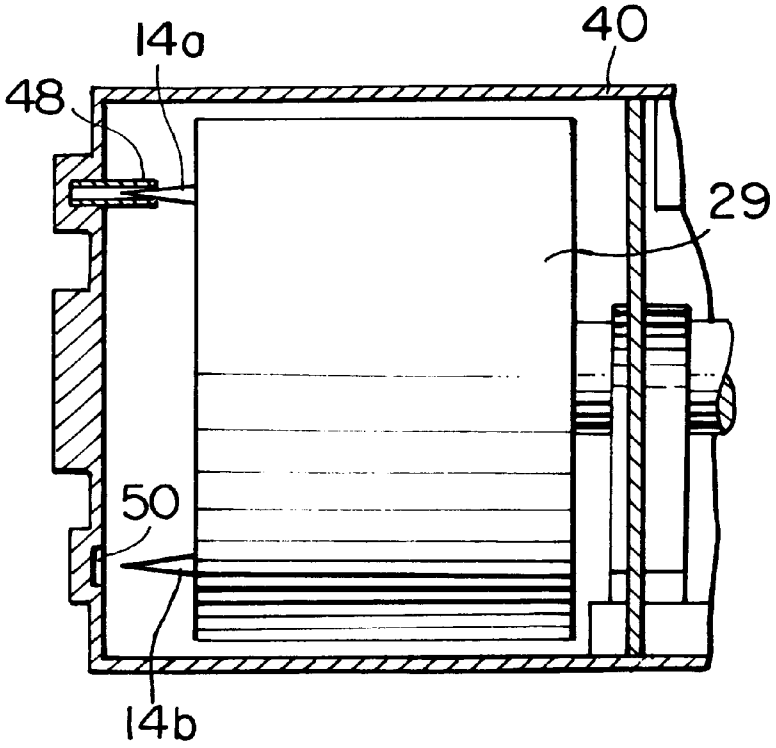
Figure 22B:
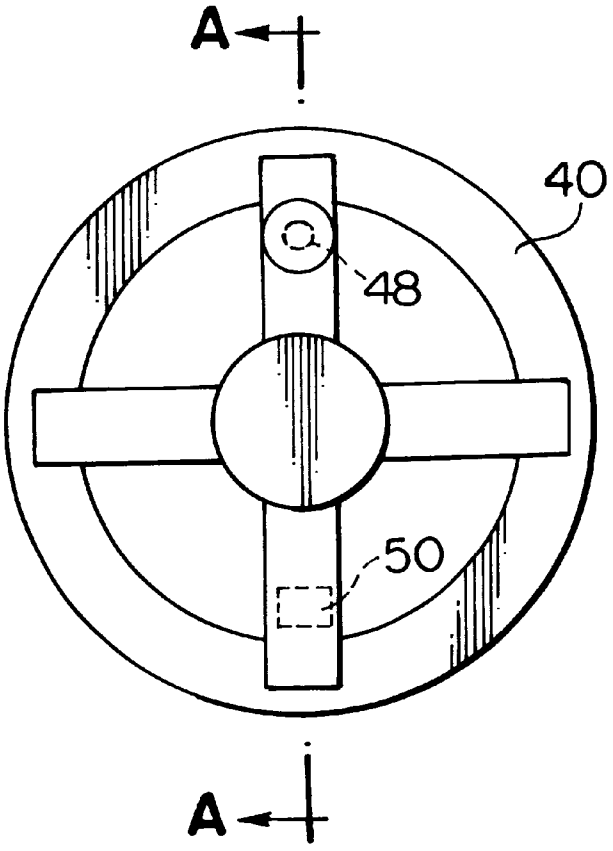
Figure 23A:
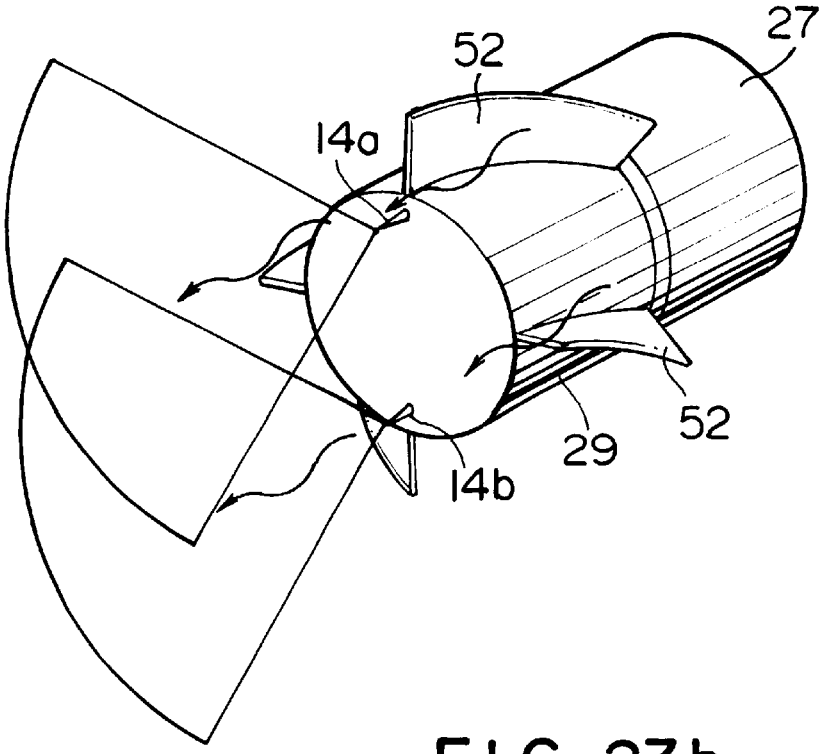
Figure 23B:
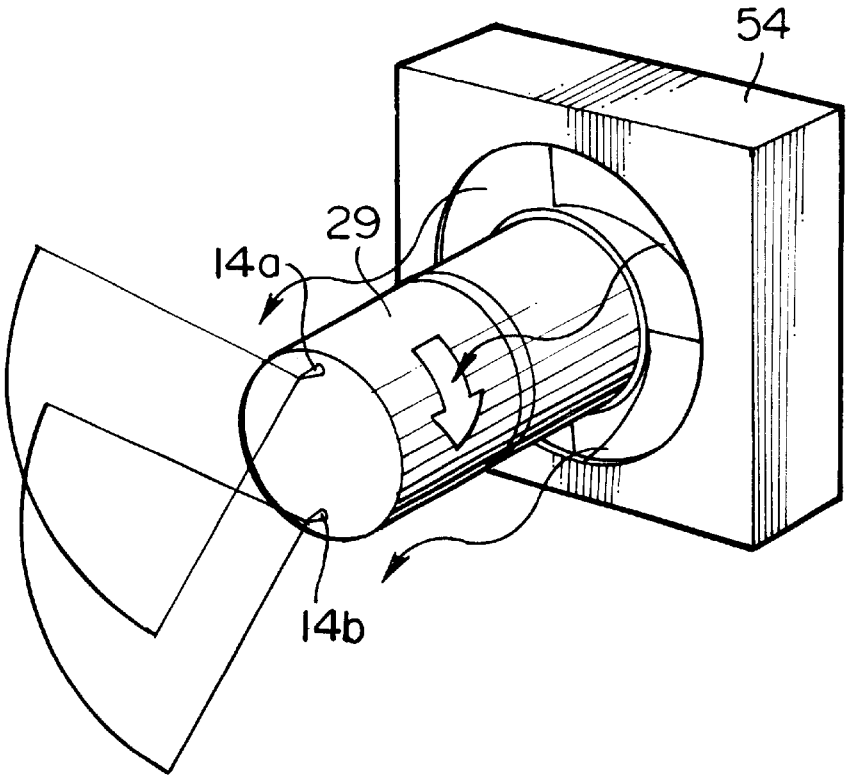
Figure 24:
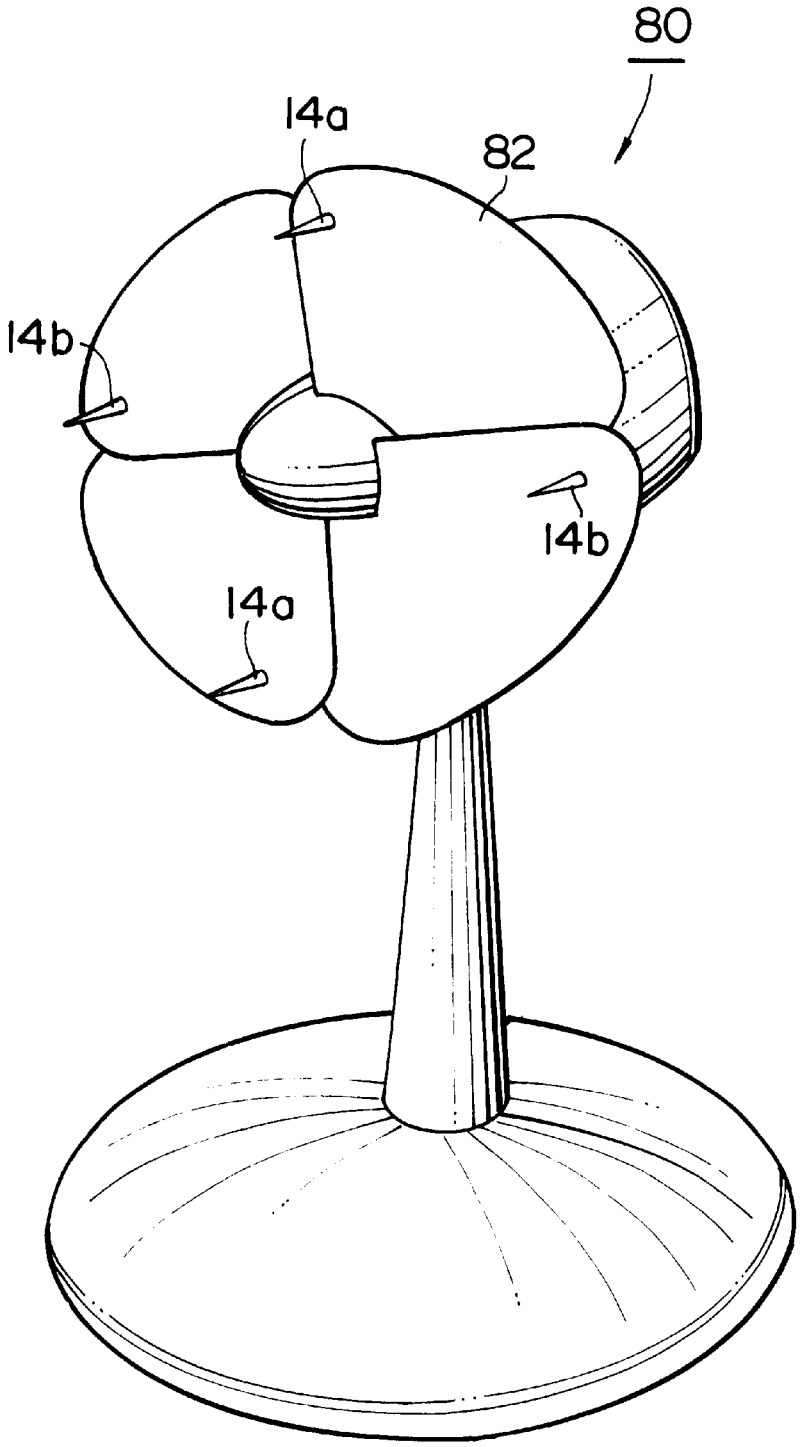
Figure 25:
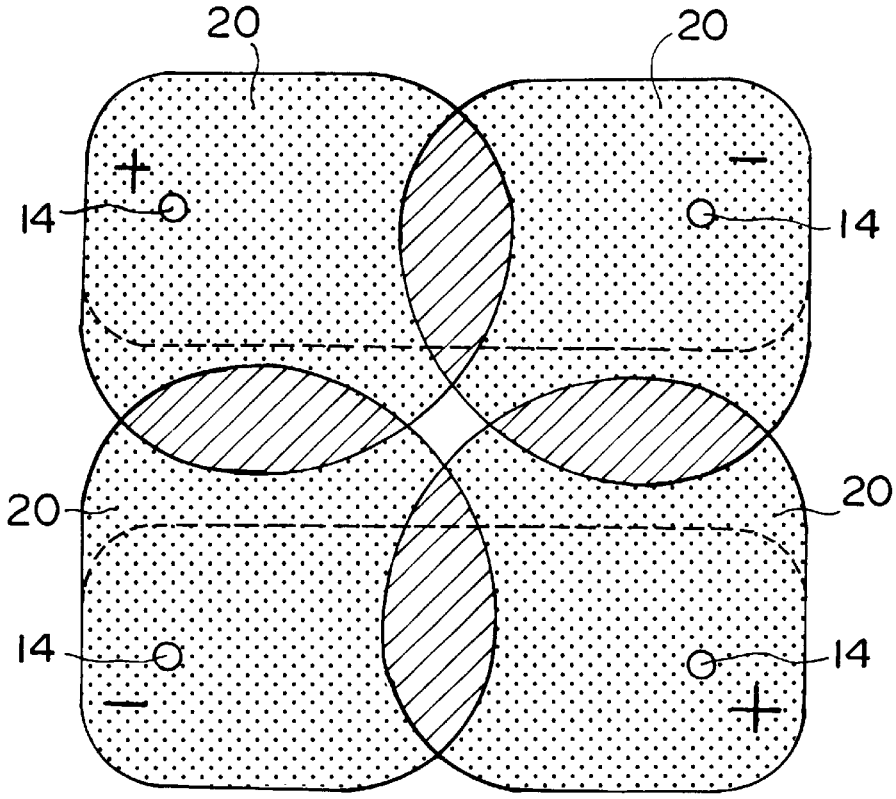
Figure 26:
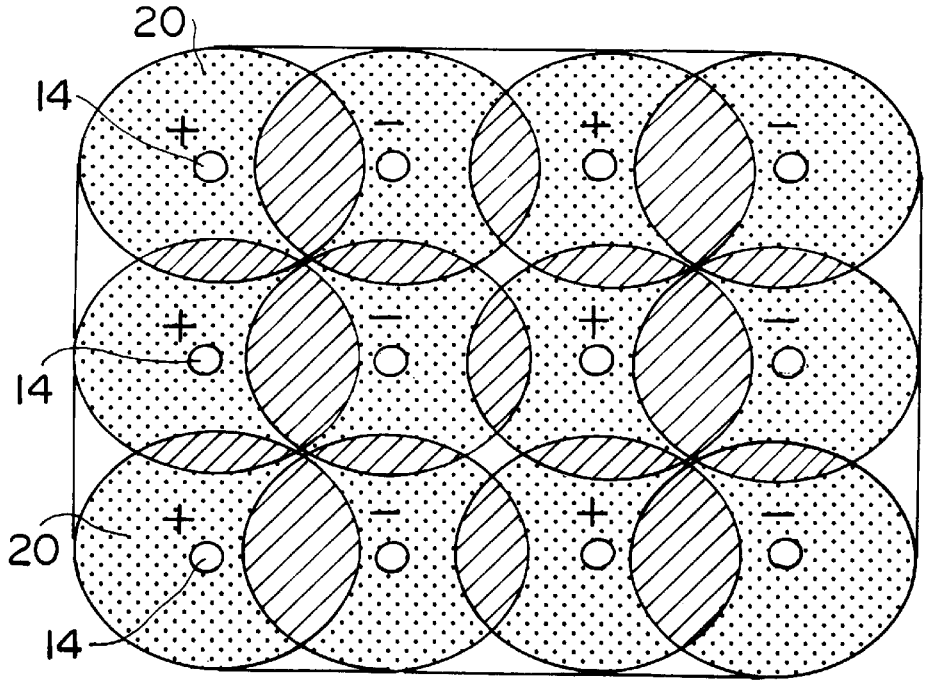
Figure 27:
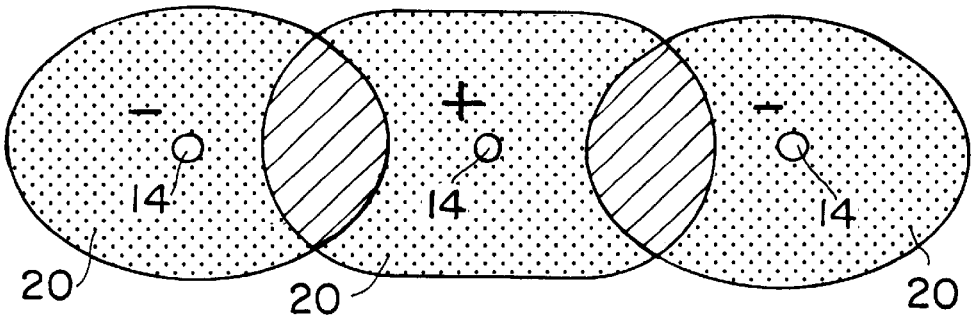
Figure 28:
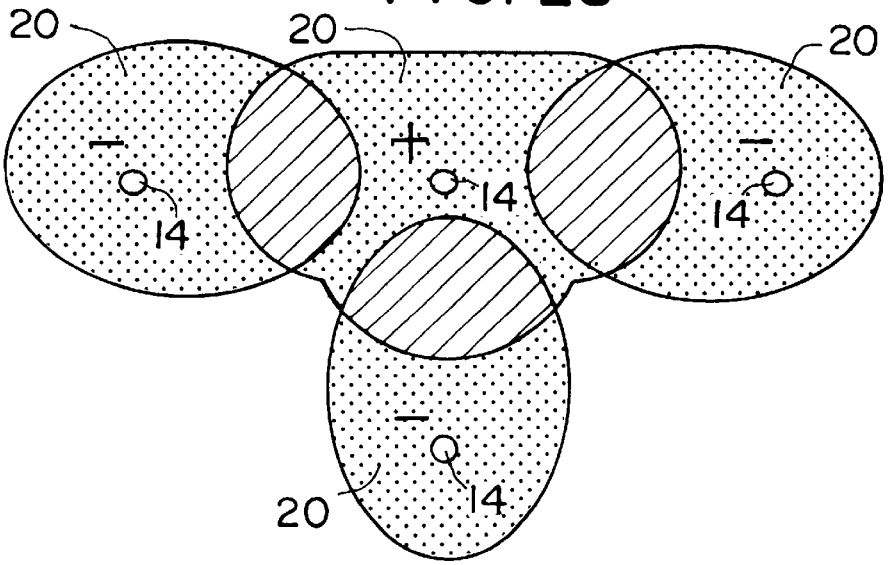
Figure 29:
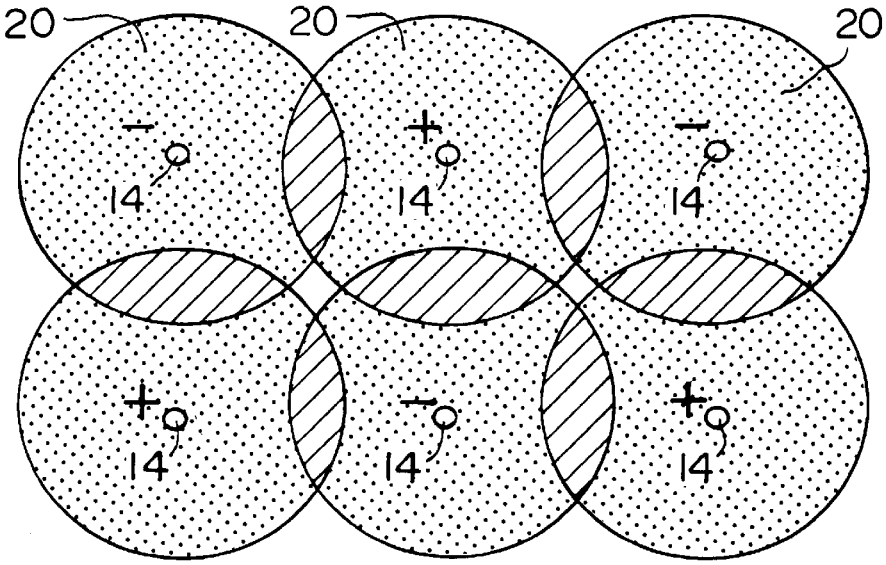

Other objects and aspects of the invention will become apparent from the following description of the embodiments with reference to the accompanying drawings in which:

FIG. 1 is a diagrammatic view for showing a conventional static eliminator,

FIG. 2 is a view for showing a waveform of voltage applied on electrodes of the static eliminator shown in FIG. 1, FIG. 3 is a perspective view of the static eliminator shown in FIG. 1, FIG. 4 is a view for explanation on a conventional static eliminator, FIG. 5 is a view for explanation on a conventional static eliminator, FIG. 6 is a view for explanation on a conventional static eliminator, FIG. 7 is a view for explanation on a push-pull type of static eliminator according to the present invention, FIG. 8 is a view for explanation on a push-pull type of static eliminator according to the present invention, FIG. 9 is a view for explanation on a conventional static eliminator, FIG. 10 is a view for explanation on a push-pull type of static eliminator according to the present invention, FIG. 11 is a view for explanation on a push-pull type of static eliminator according to the present invention, FIG. 12 is a view for explanation on a push-pull type of static eliminator according to the present invention, FIG. 13 is a diagrammatic block of a static eliminator according to the present invention, FIG. 14 is a waveform of a voltage applied on electrodes of static eliminator shown in FIG. 13, FIG. 15 is a perspective view of a static eliminator shown in FIG. 13, FIG. 16 is a diagrammatic view for explanation on the disadvantage of the conventional static eliminator, FIG. 17 is a diagrammatic view for explanation on the disadvantage of the conventional static eliminator, FIG. 18 is a diagrammatic view for explanation on the disadvantage of the conventional static eliminator, FIG. 19 is a perspective view for showing a static eliminator according to the present invention, FIG. 20 is a perspective view for showing a main body of the static eliminator, FIG. 21 is a cross-sectional view of an inner structure of the main body, FIG. 22 is a side view and a cross-sectional view of a modified embodiment, FIG. 23 is a perspective view of another modified embodiment, FIG. 24 is a perspective view of a still another modified embodiment, FIG. 25 is a plan view showing an array of discharge electrodes according to the present invention, FIG. 26 is a plan view showing an array of discharge electrodes according to another embodiment of the present invention, FIG. 27 is a plan view showing an array of discharge electrodes according to a still another embodiment of the present invention, FIG. 28 is a plan view showing an array of discharge electrodes according to a still another embodiment of the present invention, and FIG. 29 is a plan view showing an array of discharge electrodes according to a still another embodiment of the present invention.

PREFERRED EMBODIMENT OF THE INVENTION

Referring now to FIG. 7, there are shown one pair of discharge electrodes indicated at A and B. When the discharge electrode A issues, for example, plus ions, the discharge electrode B issues minus ions. At the next time, the discharge electrode A issues minus ions and the discharge electrode B issues plus ions. In a similar manner, the polarities of ions are sequentially switched over to the opposite polarities so that the polarities of ions issued from the different discharge electrodes are opposite to each other. Since ions of opposite polarities attract each other, the ions issued from the discharge electrodes A and B attract each other and fly toward the other area 60, 60. In FIG. 7, the ion area where conventional discharge electrodes occupy extends laterally and do not attain a long distance while in the push-pull type of static eliminator according to the present invention, the ion areas 20, 20 extend longitudinally. As a result, no-ion area between the discharge electrodes is not generated. On time axis, since at the next time, polarities of ions issued from the discharge electrodes A and B are changed to opposite ones, the plus and minus ions are applied to the object disposed between the discharge electrodes, so that the static electricity charged on the object is removed.

FIG. 8 shows space potential in the area between the discharge electrodes A and B along time axis. FIG. 8*a* shows space potential in the area between the discharge electrodes A and B for the period T1. The plus ions fly from discharge electrode A to the central area and the minus ions fly from discharge electrode B to the central area at the same time. At the central area the ions of opposite polarities recombine to disappear. FIG. 8*b* shows space potential in the area between the discharge electrodes A and B for the period T2. The minus ions fly from discharge electrode A to the central area and the plus ions fly from discharge electrode B to the central area at the same time. At the central area the ions of opposite polarities recombine to disappear.

FIG. 8*c* shows the integrated value of space potential for the period of T1 and T2. The plus and minus ions fly from discharge electrode A to the central area and the minus and plus ions fly from discharge electrode B to the central area at the same time. Thus, the area is always full of plus and minus ions with the resultant polarity being neutral, which forms the area where static electricity can be removed.

FIG. 9 shows a state in that in conventional static eliminator, ions are blown away by the wind. The ions issued from both discharge electrodes are blown away by stream of air since the attractive force is not exerted between the ions. On the other hand, as shown in FIG. 10, in the push-pull system according to the present invention since the ions attract each other, the ions are not blown away against stream of air. Thus, even in the bad environment where the stream of air is present, the area where static electricity can be removed can be attained.

FIG. 11 shows a gate type of static eliminating system. As shown in FIG. 11, very wide static eliminating system can be embodied. FIG. 12 shows a new static eliminating system in a clean room. As shown in FIG. 12, the ions which attract each other are issued from the ceiling and floor. As a result, the neutral ion space can be constructed to be used as static eliminating area.

As shown in FIGS. 13 through 15, it is preferred that pulse-shaped voltages are applied on the discharge electrodes 14, 14 which are opposed to each other. The distance between the discharge electrodes is selected so that the ions are issued into space by coulomb's force adjacent the discharge electrodes, that is, flies approximately 2 m and when the ions approach to each other the ions attract each other to fly farther, that is, approximately 0.5 m farther. The distance is selected between 30 cm and 5 m. In such a case, the fan used in a conventional static eliminator is no necessary.

Now another embodiment according to the present invention will be explained. FIG. 19 shows a perspective view of a static eliminator according to the present invention. The static eliminator 10 comprises a main body 25 and a stand 23 for supporting the main body 25. Equally mixed plus and minus ions are issued through ion issuing exit provided at the front portion of the main body.

FIG. 20 diagrammatically shows an inner construction of the static eliminator shown in FIG. 19. The static eliminator includes a direct current type of static eliminator 29, hereinafter referred to as "ionizer", at its front side which rotates slowly and a drive 27 at its rear side which drives the ionizer. The ionizer is provided with discharge electrodes 14*a* ands 14*b* at its front portion.

FIG. 21 shows a cross-sectional view of the inner construction of the static eliminator. The rotary ionizer 29 is supported on a rotary shaft 32 and is supplied with a power through a slip ring 36, and transmits and receives control signals. The rotary shaft 32 is connected to a motor 30 through a connecter 38 to be driven.

A power is supplied from a outside power supply 46 to the control 42 from which the power is supplied to the motor 30 and the ionizer 29 through the slip ring 36. The static eliminator is provided with a display and control panel 44 operated by an operator on its upper portion. The aforementioned parts are accommodated in a housing 40.

FIG. 22 shows an example for application. The discharge electrodes or needles 14*a* and 14*b* rotates slowly. When a cleaning blush 48 is provided in front of the discharge electrodes 14*a* and 14*b*, the discharge electrodes pass through the cleaning brush 48 and therefore the cleaning of the discharge electrodes is always made. Thus, the cleaning of the discharge needles is automated. Otherwise the cleaning should be made by an operator.

In a similar manner, when an ion sensor 50 is provided in front of the discharge needles, since the discharge needles pass by in front of the ion sensor, the sensor 50 can detect the quantity of ions. The quantity of issued ions or balance of ions can be monitored on the basis of the quantity of ions thus obtained. In such a case, the noise due to electrostatic induction, of course, should be removed. That can be made in the following: another sensing electrode is provided in the place where ions are not directly caught by the discharge electrode and the value of electrostatic induction is detected to offset the value obtained from the ion sensor 50. The detailed explanation thereof is omitted herein.

FIG. 23 shows another example for application. Although the present invention is characterized in that the ion flying distance or ion balance can be attained without use of the blower for supplying the wind from the outside, the blower also may be utilized together, if the ion flying distance is short or it is desired that the ions is flied away farther.

FIG. 23*a* shows an apparatus in which the ionizer is provided with blades at its circumferential surface. That is, the ionizer 29 is provided with blades 52 at its circumferential surface. When the ionizer 29 is caused to rotate, the forward wind is generated by the blades 52.

FIG. 23*b* shows another apparatus in which a blower is provided behind the ionizer. That is, a blower 54 is provided behind the body 25 to generate a forward wind.

FIG. 24 shows a still another embodiment. The discharge electrodes 14*a* and 14*b* is embedded in the blades 82 of the blower 80 and the ionizer 29 is provided at the center of a rotary shaft. It can be thought that the body of the ionizer is not provided at the rotary portion and instead it is provided on the fixed portion so that a high voltage is supplied through a slip ring and the blades are provided with only discharge electrodes. However, it is not preferred for reliability in that a high voltage is connected through the slip ring or the like and it is also not preferred in that there is a problem that the electric wave noise is generated. On the other hand, according to this embodiment, the static elimination can be made similar to that of the blower and the blower with an ionizer can be embodied.

FIG. 25 is a plan view showing an array of discharge electrodes. For example, one pair of discharge electrodes 14, 14 is provided so that one discharge electrode 14 is arrayed or disposed laterally of the other discharge electrode 14. The other pair of discharge electrodes 14, 14 is disposed parallel to the one pair of discharge electrodes 14, 14 thereabove or therebelow. The polarities of ions issued from adjacent discharge electrodes are made to be opposite to each other. Thus, the ions are attracted to each other between the upper and lower discharge electrodes. As a result, the area of ions are spread so that a continuous area of ions is generated between the upper and lower discharge electrodes. Assuming that the vertically adjacent discharge electrodes issue the same polarity of ions between one pair of upper discharge electrodes or one pair of lower discharge electrodes. In such a case, the ions of the same polarity are repelled to each other between the upper and lower discharge electrodes so that a continuous ion area is not generated and no-ion area where the static electricity cannot be removed is generated.

FIG. 26 shows a generalized model derived from the aforementioned principle. Plurality of pair of discharge electrodes or plurality of discharge electrodes are arrayed or disposed. In this case, the adjacent discharge electrodes are constructed so that they issue the ions of opposite polarities.

FIGS. 27 through 29 show a generalized model derived from that shown in FIG. 25. FIG. 27 shows a model in which three discharge electrodes are used. FIG. 28 shows a model in which four discharge electrodes are used. FIG. 29 shows a model in which six discharge electrodes are used. In any model, ion area can be spread.

I claim:

1. A direct current type of static eliminator which comprises at least one pair of discharge electrodes spaced apart a given distance and facing toward each other from opposite sides so that one of said pair of discharge electrodes disposed at one side points toward the other of said pair of discharge electrodes disposed at the opposite side, and power supply means for first providing one discharge electrode with a DC voltage for issuing ions of one polarity while providing the other discharge electrode with a DC voltage for issuing ions of the opposite polarity and then synchronously switching the DC voltage provided to the one discharge electrode for issuing ions of the opposite polarity while providing the other discharge electrode with a DC voltage for issuing ions of the one polarity.

2. A static eliminator according to claim 1 wherein the distance between said discharge electrodes is selected so that the ions issued from one of said discharge electrodes overlap an ion-issuing area of and attract the ions issued from the other of said discharge electrodes.

3. A static eliminator according to claim 2 in which said distance is more than 30 cm and less than 5 m.

4. A static eliminator according to claim 1 in which the ions issued from one discharge electrode attract the ions issued from the other discharge electrode.

5. A static eliminator according to claim 1 in which an object that has static charges thereon is positioned in a space between said discharge electrodes where the ions issued from one discharge electrode overlap the ions issued from the other discharge electrode such that the static charges are statically eliminated.

6. A static eliminator according to claim 1 in which the issued ions from the discharge electrodes overlap without the need for any blowing mechanism to blow the ions.

7. A static eliminator which comprises at least one pair of discharge electrodes mounted on a rotatable static eliminator body so as to be spaced apart and facing outwardly in parallel on opposite sides of an axis of rotation defined between them, power supply means for providing one discharge electrode with a DC voltage for issuing ions of one polarity while providing the other discharge electrode with a DC voltage for issuing ions of the opposite polarity, and rotation means for rotating the static eliminator body about the axis defined between the discharge electrodes.

8. A static eliminator according to claim 7 which further includes a blower for supplying wind to blow the ions issuing from the discharge eletrodes.

9. A static eliminator according to claim 8 in which said blower constitutes the static eliminator body and is provided with the ion issuing discharge electrodes on its blades.

10. A static eliminator according to claim 7 which further comprises a detector for detecting quantities of ions issuing downstream of said discharge electrodes.

11. A static eliminator according to claim 10 in which the quantity of plus ions or the quantity of minus ions or both are adjusted by adjustment to the discharge electrodes or an alarm is issued when the quantity of plus ions or the quantity of minus ions becomes less than a predetermined value or the difference between the both becomes more than a predetermined value.

12. A static eliminator according to claim 7 which further comprises a brush provided downstream of said discharge electrodes to clean said discharge electrodes.

13. An array type of static eliminator which comprises one pair of discharge electrodes mounted adjacent in spaced apart relation to each other and facing outwardly in parallel with each other, and at least a second pair of discharge electrodes disposed longitudinally or laterally adjacent in spaced apart relation to said one pair of discharge electrodes, power supply means for providing one discharge electrode of each pair with a DC voltage for issuing ions of one polarity while providing the other discharge electrode of each pair with a DC voltage for issuing ions of the opposite polarity, and the discharge electrodes of the at least two pairs of discharge electrodes are arranged with respect to each other such that the polarity of ions issued from each of the discharge electrodes is opposite to the polarity of ions issued from each laterally and longitudinally adjacent one of the other discharge electrodes.

* * * * *